US005224816A

United States Patent [19]

Kaczmarczyk et al.

[11] Patent Number: 5,224,816

[45] Date of Patent: Jul. 6, 1993

[54] MOUNTING STRUCTURE FOR A LOADER ATTACHMENT

[75] Inventors: Edward T. Kaczmarczyk, Welland; Roger A. Noyes, Niagara Falls, both of Canada

[73] Assignee: Deere & Company, Moline, Ill.

[21] Appl. No.: 791,801

[22] Filed: Nov. 13, 1991

[51] Int. Cl.[5] ..... E02F 3/28

[52] U.S. Cl. ..... 414/723; 172/275

[58] Field of Search ..... 414/723, 912; 172/272-275, 481; 37/231, 236, DIG. 12

[56] References Cited

U.S. PATENT DOCUMENTS

| | | | |
|---|---|---|---|
| 3,985,249 | 10/1976 | Aker et al. | 172/275 X |
| 3,991,890 | 11/1976 | Frank | 172/275 X |
| 4,067,467 | 1/1978 | Datta et al. . | |
| 4,085,856 | 4/1978 | Westendorf . | |
| 4,106,645 | 8/1978 | Janish | 414/723 |
| 4,136,792 | 1/1979 | Wilson . | |
| 4,846,624 | 7/1989 | Hohn | 172/275 X |
| 4,986,722 | 1/1991 | Kaczmarczyk et al. . | |

FOREIGN PATENT DOCUMENTS

| | | | |
|---|---|---|---|
| 1164323 | 2/1964 | Fed. Rep. of Germany | 414/723 |
| 2302012 | 9/1976 | France | 172/275 |
| 1247470 | 7/1986 | U.S.S.R. | 414/723 |

*Primary Examiner*—David A. Bucci
*Assistant Examiner*—William M. Hienz

[57] ABSTRACT

A tractor-mounted loader has a quick coupler mounted to forward ends of the boom arms thereof. The quick coupler includes a pair of attachment holders having their lower ends respectively pivotally connected to the pair of arms and selectively pivotable by a pair of attachment tilt cylinders. An attachment in the form of a bucket includes a pair of connecting brackets including pins engageable by recesses in the upper ends of the holders and receptacles for receiving coupler elements carried by the holders. A pair of latch mechanisms are respectively carried by the pair of brackets and include spring-loaded latch pins which normally assume a latch position blocking passage of the coupler elements to or from the receptacles but which include ramp surfaces that cooperate with ramp surfaces of the coupler elements to cause the pins to be automatically moved from their latch positions to permit passage of the coupler elements into the receptacles during mounting of the attachment to the attachment holders. The latch pins may be manually moved to an unlatch position from which they are automatically released by being contacted by wedges carried by the holders when the latter are moved to a position disposing the coupler elements free of the receptacles during detachment of the attachment from the holders. An alternate embodiment shows the coupler elements formed by the mounting brackets and the receptacles formed by the holders with the latch mechanisms being mounted to the holders.

10 Claims, 4 Drawing Sheets

FIG. 1
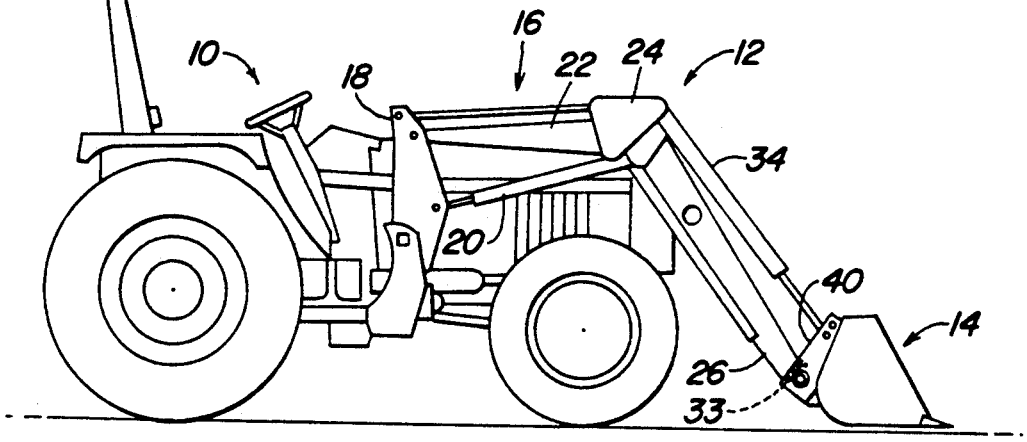
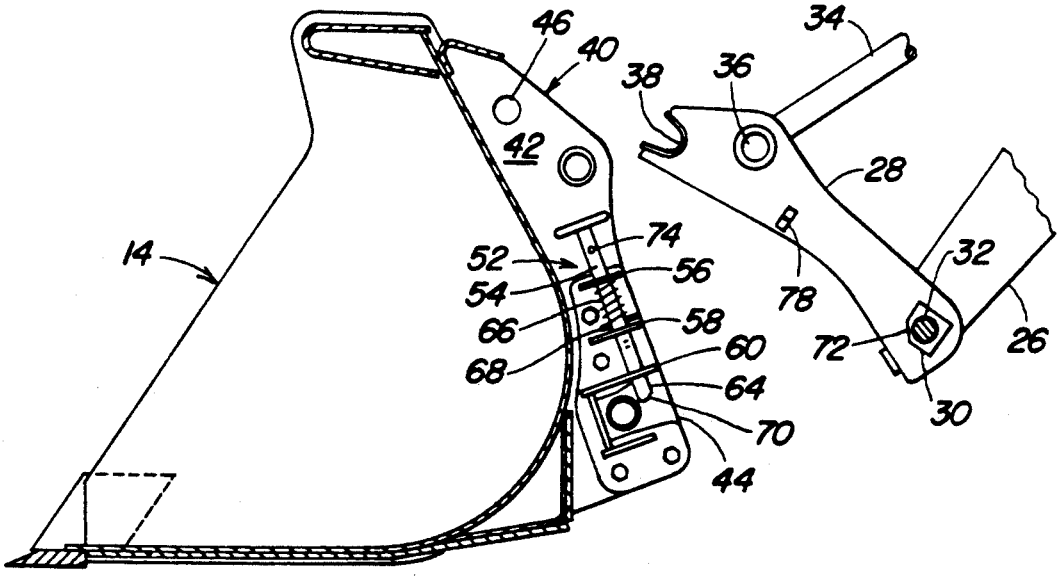
FIG. 2

FIG. 7
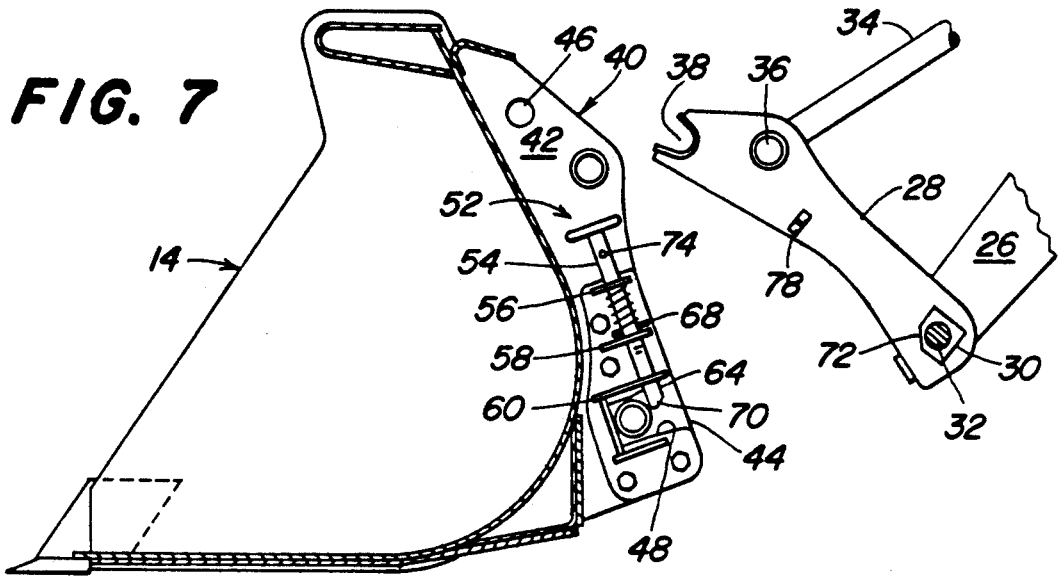
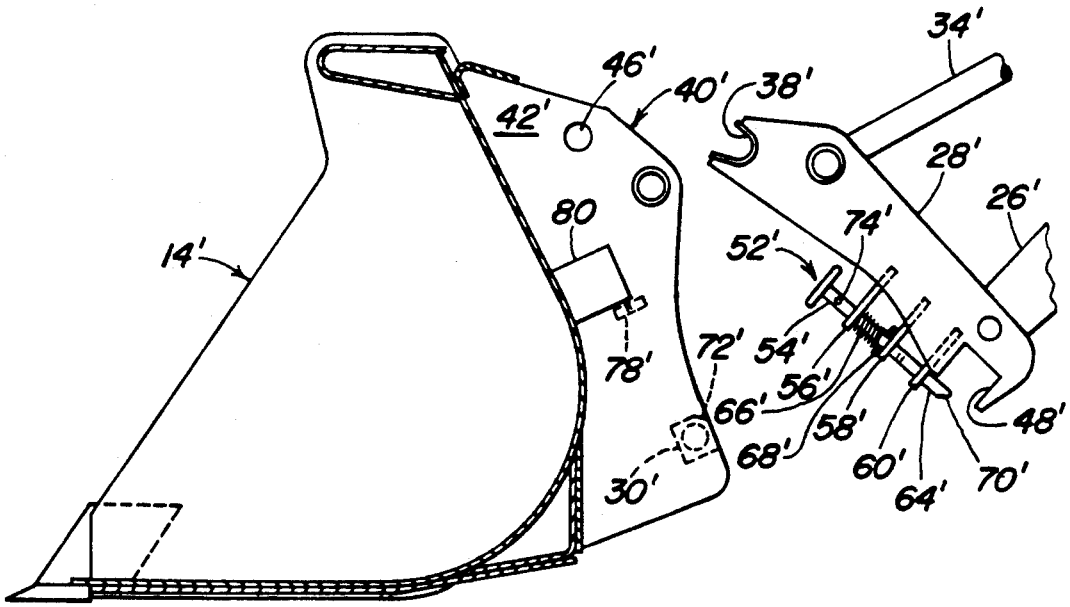
FIG. 8

MOUNTING STRUCTURE FOR A LOADER ATTACHMENT

ASSIGNMENT

The entire right, title and interest in and to this application and all subject matter disclosed and/or claimed therein, including any and all divisions, continuations, reissues, etc., thereof are, effective as of the date of execution of this application, assigned, transferred, sold and set over by the applicant(s) named herein to Deere & Company, a Delaware corporation having offices at Moline, Ill. 61265, U.S.A., together with all rights to file, and to claim priorities in connection with, corresponding patent applications in any and all foreign countries in the name of Deere & Company or otherwise.

BACKGROUND OF THE INVENTION

The present invention relates to a loader and, more specifically, to structure for mounting a bucket or similar attachment to a loader.

It is common practice to provide the forward end of loader arms with a quick coupler for attaching a bucket or other implement to the loader arms. In order to make the task of attachment easy for an operator, it is known to provide the implement connection bracket with a spring loaded pin which is automatically latchable to capture each quick coupler in place during the attachment procedure, thus making it possible for the operator to attach an implement to the loader arms without dismounting the tractor carrying the loader. U.S. Pat. No. 4,986,722 issued on 22 January 1991 discloses a quick coupler of this type.

The patented structure has the disadvantage that to ready the implement for attachment the latch pin carried thereby must be placed in its release position wherein it is apt to be accidentally tripped, during the mounting procedure, to permit its movement to its latched position. When this happens, the operator must dismount the tractor and once again move the pin to its release position.

SUMMARY OF THE INVENTION

According to the present invention there is provided an improved mounting structure for a loader boom attachment and more specifically there is provided such a structure which overcomes the aforementioned disadvantage.

An object of the invention is to provide a mounting structure for a loader boom attachment which requires the operator to dismount the tractor only once during the procedure of attaching and detaching an implement from the loader arms.

Another object of the invention is to provide a mounting structure for a loader boom attachment which includes an automatically actuated latch pin which is operative to permit connection no matter whether it is in its raised release position or in its lowered latching position.

In accordance with the above objects, a loader structure is provided which includes relatively simple quick coupling structure including a carrier comprising a pair of boom-mounted attachment holders and a pair of implement-mounted mounting brackets with which a pair of releasable spring-loaded latch pins are respectively associated and adapted for securing the holders to the brackets when operated automatically during the attachment procedure. The pins are in normal, latching positions when the implement is detached from the attachment holders. The bottom ends of the pins are provided with ramp surfaces which cooperate with ramp surfaces provided on coupling pins located at lower locations of the attachment holders so that the pins are raised from their latching position as the coupling pins move into position in respective receptacles provided on the backside of the implement, the latch pins then reassuming their normal latching position once the coupling pins have moved into place.

In an alternate embodiment, the latch pins are carried by the holders and the coupling pins are carried by the implement mounting brackets for reception in forwardly opening receptacles defined by the holders.

These and other objects, features and advantages of the present invention will become apparent to one skilled in the art upon reading the following description together with the appended drawings.

BRIEF DESCRIPTION OF THE DRAWINGS

FIG. 1 is a right side view of a tractor-mounted loader with an implement or attachment, shown as a bucket, connected thereto.

FIGS. 2–4 are left side views of the bucket and implement carrier, in vertical cross section, showing a sequence of positions of the carrier during the procedure of connecting a holder thereof to a mounting bracket of the bucket.

FIGS. 5–7 are left side views similar to those of FIGS. 2–4 but showing the bucket and implement carrier in a sequence of positions during the procedure of disconnecting the carrier holders from the mounting brackets of the bucket.

FIG. 8 is a left side view of the bucket and implement carrier, in vertical cross section, showing an alternate embodiment of the invention wherein the latch mechanisms are mounted on the holders and the block-like coupler elements or pins are mounted to the bucket mounting brackets.

DESCRIPTION OF THE PREFERRED EMBODIMENT

Figure 3:
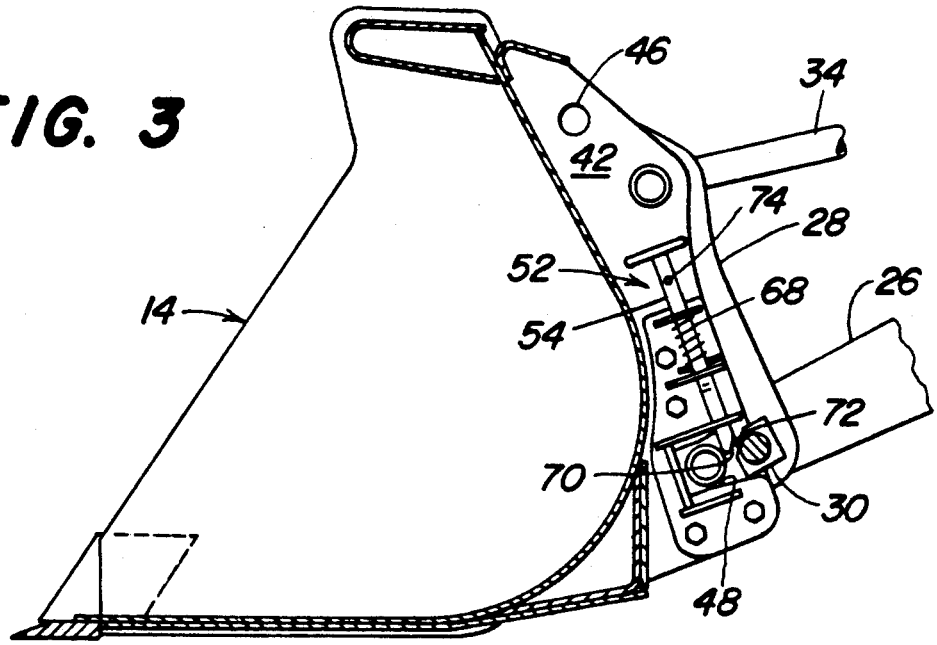

Referring now to FIG. 1, there is shown a tractor 10 having a loader 12 connected thereto and being equipped with an attachment here shown as a bucket 14. However, it is to be understood that the present invention may be used with other attachments as well.

The loader 12 includes a mast 16 pivotally connected to upright mast posts 18 for rocking in a conventional manner about a transverse axis by boom cylinders 20. The mast includes a pair of transversely spaced boom arms 22 extending forwardly from the mast posts 18 to knee joints 24. The arms 22 extend downwardly from the joints 24 to lower forward attachment carrier mounting ends 26 in which are provided horizontal transverse carrier mounting bores. The attachment carrier comprises a pair of upright attachment holders 28 which are respectively vertically pivotally mounted to the forward ends 26 of the pair of arms 22. Specifically, each holder 28 is in the form of a rearwardly opening channel and a respective arm end 26 is received between a lower location of opposite channel side walls. Projecting through and welded to the inner side wall of each of the holders 28 at the lower location is an attachment coupler element or pin 30, with the pins 30 being provided with axially aligned bores which are axially aligned with the bores in the forward ends 26 of the boom arms 22. The coupler elements 30 are each in the form of a block having a square cross section. A cross rod 32, or it could be a cross tube, extends between the holders 28 and has its opposite ends received in and pinned to the block-like coupler elements 30. Holder coupling pins 33 (FIG. 1) are inserted through holes provided in outer side walls of the holders 28 and the forward ends 26 of the boom arms 22 and terminate in the coupler elements 30 where they are pinned in place in a conventional manner, not shown. Coupled between the knee joint 24 of each arm 22 and a respective one of the holders 28 is a hydraulic cylinder 34 having its rod end coupled, as by a pin 36, to an upper location of the holder 28 whereby the holders may be selectively rocked about their pivotal connections with the arms 22 by extension or retraction of the cylinders 34. Formed in the upper extreme end of each of the holders 28 is an upwardly opening, u-shaped recess or saddle 38 having a purpose described below.

The attachment or bucket 14 includes mounting structure for mating with the attachment holder 28, for firm support on the boom arms 22. Specifically, the mounting structure includes a pair of transversely spaced upright mounting brackets 40 fixed to the rear wall of the bucket 14. Each bracket 40 includes inner and outer, transversely spaced plates 42 and 44, respectively, and opens rearwardly for receiving the corresponding attachment holder 28. Near the top of each bracket 40, a pin 46 extends transversely through and between the plates 42 and 44. Spaced below the pin 46 in a location adjacent the bottom of the brackets 40, each inner mounting plate 42 is provided with a rearwardly opening receptacle 48 that is shaped complimentary to and for receiving a respective one of the block-like coupler elements 30 carried by the holders 28. The spacing of the recess 38 from the coupler element 30 of each of the holders 28 is the same as the spacing between the pin 46 and the receptacle 48 of a respective mounting bracket 40 so that the recess 38 is engaged with the pin 46 when the coupler element 30 is received in the receptacle 48. It is here noted that, instead of the pin 46, each mounting bracket 40 could be provided with a downwardly opening receptacle and each holder 28 could have an upper end defined by a pin which fits into the receptacle to cooperate therewith and, in effect, form a horizontal pivot axis.

For the purpose of releasably retaining the coupler elements 30 in place in the receptacles 48, each of the brackets 40 is provided with a latch mechanism 52 mounted to the inner surface of the inner mounting., plate 42 so as to be visible to an operator seated on the tractor 10. Specifically, each latch mechanism 52 includes a generally upright latch pin 54 reciprocably received in aligned apertures provided in upper, intermediate and lower spaced apart mounting tabs 56, 58 and 60, respectively, which are welded to the inner surface of a plate bolted to the inner mounting plate 42. The latch pin 54 is biased to a normal latching lower position, as shown in FIG. 2, wherein a lower end portion 64 thereof extends below the lower mounting tab 60. This biasing is accomplished by a coil compression spring 66 received about the latch pin 54 and having an upper end engaged with the underside of the upper mounting tab 56 and having a lower end engaged with a spring retainer pin 68 extending through a hole provided in the latch pin 54 at a location disposing the retainer pin 68 above the intermediate mounting tab 58. A notch (not visible) is provided in the latch pin 54 at a location which is spaced below the upper mounting tab 56 when the pin 54 is in its normal lower position, the notch being engageable with the upper mounting tab 56 for holding the pin in a raised, unlatched or release position shown in FIG. 5 wherein the lower portion 64 is raised to the level of the lower tab 60 and to which the pin is manually moved when it is desired to detach the bucket 14 from the loader boom arms 22. Provided on the bottom of the latch pin 54 is a ramp surface 70 which cooperates with a respective ramp surface 72 provided on each of the block-like coupler elements 30 to automatically raise the latch pin 54 to permit the coupler elements 30 to move into the receptacles 48 during the attachment procedure discussed below in detail.

Each of the latch pins 54 includes a trip pin 74 located in an upper location thereof and projecting into an elongate hole 76 (FIG. 5) provided in an adjacent one of the mounting plates 42 so that an end thereof is positioned slightly within the space between the plates 42 and 44 when the latch pins 54 are in respective unlatched positions. Automatic disengagement of the latch pins 54 from their unlatched positions is accomplished during detaching the bucket from the loader arms 22 by means of a pair of trip surfaces in the form of wedges 78 that are respectively fixed to the inner surfaces of the pair of the holders 28 in a position for engaging a respective one of the trip pins 74 as the attachment holders 28 are rolled forwardly to disengage the coupler elements 30 from the receptacles 48, engagement of the trip pins 74 occurring as the coupler elements 30 move beneath the latch pins 54 so that the latter can slide over the coupler elements 30 and move to their normal latched positions as the coupler elements move past the latch pins.

Referring now to FIG. 8, there is shown another embodiment of the invention, with structure which is the same or somewhat similar to structure already described being given the same number but with a prime designation. Specifically, there is shown a bucket 14' having a right attachment bracket 40' at the back side thereof. A pin 46' is fixed between upper locations of the opposite side plates of each bracket 40' and a coupler element or pin 30' of square cross section is fixed between lower locations of the opposite side plates of each bracket 40'. The central, upper rear side of the coupler element 30' is provided with a ramp surface 72' having a purpose explained below. A wedge 78' is fixed to the inside of one of the opposite side plates of each bracket 40' and projects a preselected distance toward the other side plate for a purpose explained below. Located in each of the bracket side plates carrying one of the wedges 78' is a latch pin access opening 80.

An implement carrier is mounted to the forward ends 26 of the loader arms 22 and includes a pair of holders 28' respectively coupled to the pair of arms. Each holder 28' includes spaced parallel side plates having the upper ends thereof joined by a saddle 38' that is provided for engagement with the pin 46' of one of the bucket brackets 40'. A forwardly opening receptacle 48' is formed in a lower forward location of the holder 28' so as to be spaced from the saddle 38' such that when the saddle is engaged with the pin 46' the bucket can be positioned with the coupler element 30' received within the receptacle 48'. A latch mechanism 52' is mounted to the holder 28' and includes an upright latch pin 54' that is reciprocably received in aligned apertures provided in upper, intermediate, and lower spaced apart mounting tabs 56', 58' and 60', respectively, that are welded between and project forwardly of the side plates of the holder 28'. The latch pin 54' is biased to a normal lower latching position, as shown, wherein a lower end portion 64' thereof extends below the lower mounting tab 60'. This biasing is accomplished by a coil compression spring 66' received about the latch pin 54' and having an upper end engaged with the underside of the upper mounting tab 56' and having a lower end engaged with a spring retainer pin 68' extending through a hole provided in the latch pin 54'. A notch (not visible) is provided in the latch pin 54' at a location wherein it opens toward the inside plate of the holder 28', the notch being engageable with the upper mounting tab 56' for holding the pin in a raised, release or unlatched position (not shown) wherein the lower portion 64' is raised to the level of the lower tab 60' and to which the pin is manually moved when it is desired to detach the bucket 14' from the loader boom arms 22. Access to the latch pins 54' for permitting manual movement of the pins is provided by the access holes 80. Provided on the bottom of each latch pin 54' is a ramp surface 70' which cooperates with the ramp surface 72' of an associated coupler element 30' so as to lift the latch pin 54' over the coupler element during the attaching procedure. A trip pin 74' is tightly received in a bore provided in an upper location of each of the latch pins 54' and projects therefrom so as to come into engagement with the wedge 78' anytime the associated holder 28' is moved to or from its mounting position between the side plates of the bucket mounting brackets while the latch pin 54' is in its raised release position.

OPERATION

Figure 4:
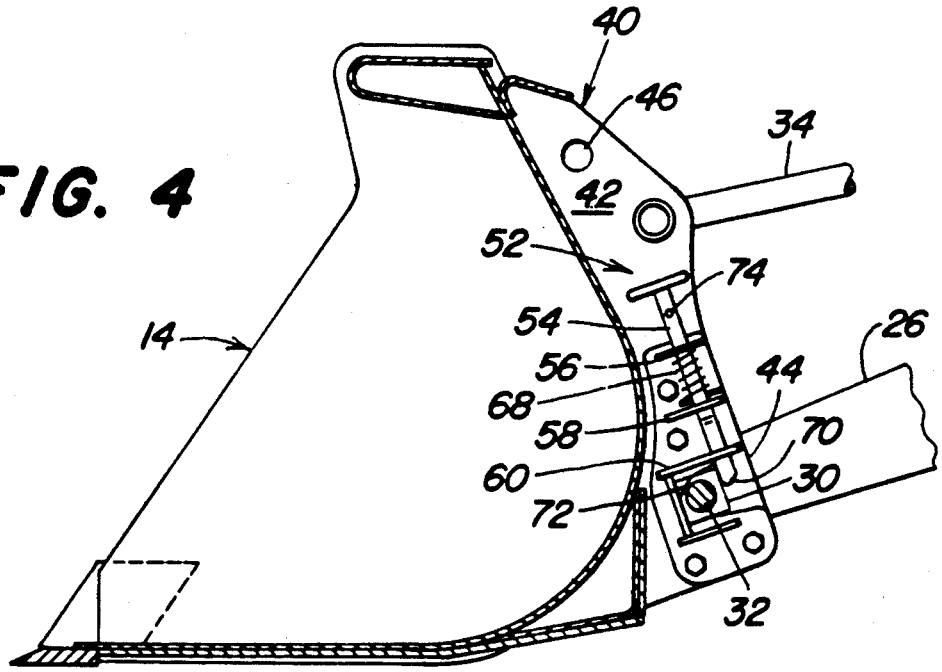

The procedure for attaching the bucket 14 to the loader arms 22 will now be described. First, with reference to the embodiment shown in FIGS. 2–7, and beginning with the bucket 14 resting on the ground, as shown in FIG. 2, the operator will maneuver the tractor 10 and operate the boom cylinders 20 so as to place the attachment holders 28 rearwardly of and adjacent to the mounting brackets 40 of the bucket 14. The hydraulic cylinders 34 are then extended to cause the attachment holders 28 to be rocked forwardly about the pivot pins 33 and the tractor 10 is driven forwardly to bring the u-shaped recesses or saddles 38 into engagement with respective mounting bracket pins 46. The cylinders 34 are then retracted while the boom cylinders 20 are operated to lift the arms 22 such that the bucket 14 becomes suspended on the holders 28. The weight of the bucket 14 causes the latter to swing rearwardly about the pins 46 so as to engage the ramp surfaces 70 of the latch pins 54 with the ramp surfaces 72 of the block-like coupler elements 30, as shown in FIG. 3. This engagement causes the latch pins 54 to be shifted upwardly, against the biasing force exerted by the springs 66, a distance sufficient for permitting the coupler elements 30 to move into the receptacles 48, as shown in FIG. 4. As the coupler elements 30 move past the lower end of the latch pins 54, the springs 66 shift the latch pins 54 back to their latch positions. The loader bucket 14 is then securely held for operation.

Figure 5:
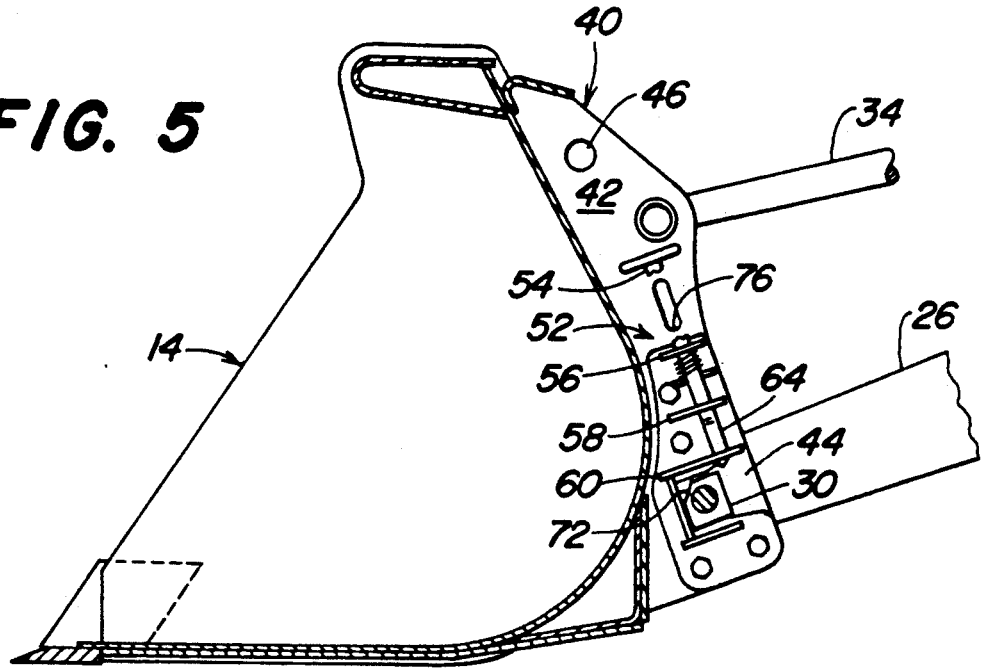

It is here noted that in the event that someone for some reason places the latch pins 54 in their raised, unlatched positions, shown in FIG. 5, prior to attaching the bucket 14 to the holders 28' the operation will be essentially the same except that, when the bucket 14 pivots rearwardly about the pin 46, the wedges 78 will contact the trip pins 74 and release the pins 54 so that they will engage and ride over the coupler elements 30 as the latter move into the receptacles 48. Once the coupler elements 30 move past the lower ends of the latch pins 54 the latter will be biased downwardly to their respective latched positions shown in FIG. 4 to thus securely fasten the bucket 14 to the holders 28.

Figure 6:
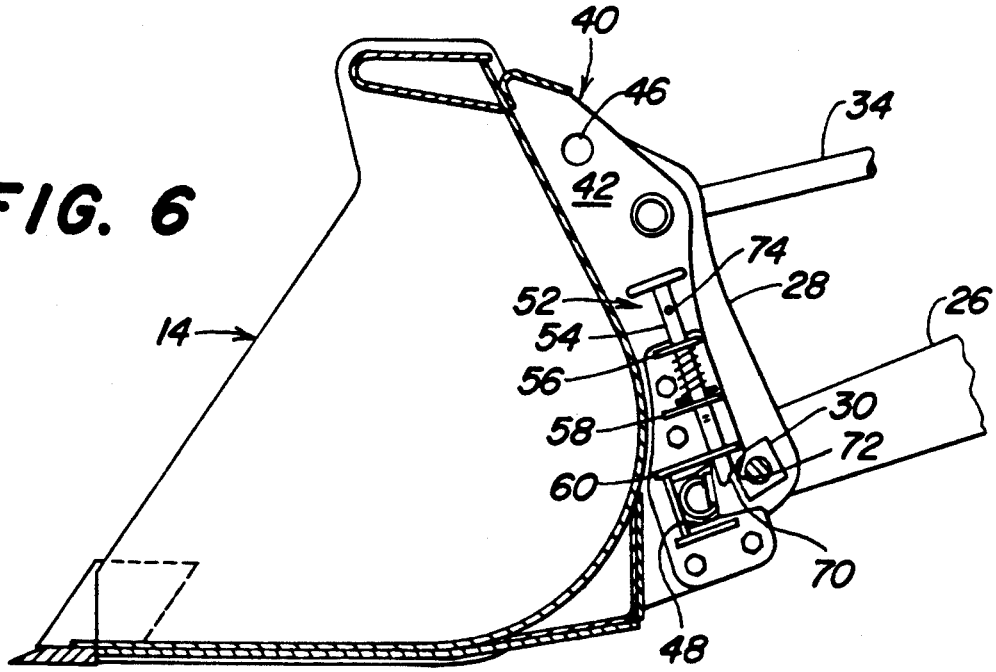

To detach the bucket 14 from the loader arms 22, the operator manually lifts the latch pins 54 to their unlatch positions and places the catch slots thereof in holding engagement with the upper tabs 56 by canting the pins in the direction of the adjacent one of the bracket plates 42, such canting causing the cross pins 74 to project through the adjacent elongate hole 76. The operator then enters the seat of the tractor, and actuates the cylinders 34 to roll the holders 28 forwardly relative to the arms 22 with the result that the holders 28 swing rearwardly about the pins 46 such that the coupler elements 30 move rearwardly from the receptacles 48. Once the holders 28 move sufficiently to dispose the coupler elements 30 beneath the latch pins 54, the wedges 78 come into contact with the pins 74 and dislodge the latch pins 54 from engagement with the upper tabs 56 so that the pins 54 are released and ride on top of the coupler elements 30 until the latter pass beneath the pins 54 thus permitting the pins to reassume their latched positions, as shown in FIG. 6. The tractor 10 is then backed up to release the holders 28 from the pins 46 to complete the separation of the bucket 14 from the holders 28 and thus the loader arms 22, as shown in FIG. 7. The tractor then may be used for other work while the bucket 14 remains in a condition for reattachment with the latch pins 54 being in their normal latched positions.

With reference to the embodiment shown in FIG. 8, the procedure of attaching the bucket 14' to, or detaching the bucket from, the attachment carrier is basically the same as that described relative to the first described embodiment. Specifically, attachment is accomplished by maneuvering the carrier so as to engage the holder saddles 38' with the pins 46' whereupon the loader arms 22 are lifted to cause the bucket to swing rearwardly about the pins 46' so as to bring the coupler elements 30' into register with the receptacles 48'. As the bucket 14' swings rearwardly, the ramp surface 72' of each coupler element 30' will engage the ramp surface 70' of one of the latch pins 54' and cause the latter to raise as the coupler element 30' moves therebeneath, the latch pin then shifting back down to its latch position so as to capture the bucket in place. Detaching of the bucket 14' is done by first reaching through openings 80 provided in the outer side plate of the brackets 40' and manually lifting each latch pin 54' to its release position and then operating the bucket and lift cylinders of the loader 16 to cause the implement carrier to be rocked rearwardly about the pins 46' so as to disengage the holder receptacles 48, from the coupler elements 30' As the latch pins 54' move rearwardly over the coupler elements 30', the trip pin 74' of each latch pin 54' comes into contact with an adjacent one of the wedges 78 which causes the associated latch pin to be automatically released so that the spring 66' biases the pin down against the coupler element, with the pin moving to its latched position once the coupler element moves from underneath the same.

We claim:

1. In a combination of a loader and an attachment wherein the loader includes a pair of vertically movable arms having forward ends respectively vertically pivotally connected to lower locations of a pair of upright attachment holders of an attachment carrier for being selectively pivoted by a pair of attachment cylinders respectively connected between the arms and upper locations of the holders; and wherein said attachment includes a pair of mounting brackets having respective upper portions cooperating with upper portions of said pair of holders to define a horizontal pivot connection between the attachment and the carrier, with one of the pair of brackets and pair of holders defining receptacles opening toward and receiving respective coupler elements defined by the other of the pair of brackets and pair of holders, and a pair of latch mechanisms being respectively mounted to said one of said pair of brackets and pair of holders and each including an upright, reciprocably mounted latch in biased to a normal lowered latching position blocking movement of the coupler elements from the receptacles and being movable to a raised, detented release position permitting movement of the coupler elements from the receptacles, the improvement comprising: each of said pair of coupler elements having an upwardly directed first ramp surface; each of said pair of latch pins having a lower end defining a downwardly facing second ramp surface located for contacting a respective first ramp surface so as to raise an associated one of the latch pins over the coupler element when the attachment and carrier are being pivoted together, about said horizontal pivot connection, with the latch pins being in their normal latching positions; and a pair of trip surfaces are respectively carried by said other of the pair of brackets and pair of holders at respective locations above said pair of coupler elements; and a trip pin being carried by each latch pin in a location that is in a path of movement of a respective one of the pair of trip surfaces when the latch pins are each in its raised detented release position whereby the trip surfaces engage the trip pins to cause each of the latch pins to be moved from its released position, to which it has previously been manually placed for the purpose of detaching the attachment from the holders, to assume its latching position once the respective lower portions of the attachment and carrier have been pivoted apart by the attachment cylinders a distance sufficient to place the coupler elements beneath the latch pins, whereby the latch pins will ride over the coupler elements and assume their latching positions once the coupler elements move away from the receptacles.

2. The combination of the loader and attachment defined in claim 1 wherein the coupler elements include a substantially square in cross section portion and the receptacles include a portion shaped complimentary to said square in cross section portion of the coupler elements.

3. The combined loader and attachment defined in claim 2 wherein the trip surfaces are in the form of laterally projecting wedges having respective bases fixed to said other of the pair of brackets and pair of holders.

4. The combined loader and attachment defined in claim 1 wherein said pair of coupler elements are respectively carried by said pair of holders and said pair of receptacles are defined by said pair of mounting brackets.

5. The combined loader and attachment defined in claim 4 wherein said pair of holders each include inner and outer side plates having a respective one of the loader arms received therebetween; said pair of coupler elements being respectively fixed to and projecting inwardly from the inner side plates of the pair of holders; said pair of brackets each including inner and outer side plates with said pair of receptacles respectively being in the inner side plates; and said latch mechanisms respectively being mounted to inner surfaces of the inner side plates of the pair of brackets.

6. The combined loader and attachment defined in claim 5 wherein each of said inner side plates of the pair of mounting brackets contains an elongated opening located beside and extending parallel to an adjacent one of the latch pins; a trip pin being carried by each of the latch pins and extending into the opening adjacent thereto; and each holder having a trip surface projecting inwardly from an inner surface of the inner side plate thereof at a location disposing the trip surface in the path of movement of the trip pin, when the latch pin is in its raised detented release position and the attachment is caused to pivot about said horizontal pivot connection to either move the coupler elements out of or into the receptacles, whereby the trip surfaces respectively engage the trip pins to release the latch pins as the coupler elements move therebeneath, the latch pins then moving to their latching positions once the coupler elements are either completely in or completely out of the receptacles.

7. The combined loader and attachment defined in claim 6 wherein said pair of trip surfaces are wedge shaped with the bases of the surfaces being joined to the inner surface of the inner side plates of the holders.

8. The combined loader and attachment defined in claim 1 wherein said pair of coupler elements respectively form part of said pair of mounting brackets and said pair of receptacles are respectively formed by said pair of holders.

9. The combined loader and attachment defined in claim 8 wherein said pair of mounting brackets each include inner and outer side plates located on opposite sides of a respective one of the pair of holders; each of said pair of coupler elements extending between and being secured to the inner and outer side plates of one of the pair of brackets; said pair of receptacles respectively being defined by said pair of holders; and said pair of latch pins being respectively mounted to central locations of the pair of holders which dispose each of the latch pins between the side plates of a respective one of the mounting brackets.

10. The combined loader and attachment defined in claim 9 wherein each of the pair of coupler elements is rectangular in cross section and has one of the pair of first ramp surfaces located at a central upper rear location thereof.

* * * * *